US005279187A

United States Patent [19]

Salmon

[11] Patent Number: 5,279,187

[45] Date of Patent: Jan. 18, 1994

[54] EXPANDABLE JAW BROKEN BOLT EXTRACTOR

[76] Inventor: Avraham Salmon, P.O. Box 6497, Ganey Yehuda, Israel, 56905

[21] Appl. No.: 913,065

[22] Filed: Jul. 14, 1992

Related U.S. Application Data

[63] Continuation-in-part of Ser. No. 705,515, May 24, 1991, abandoned.

[51] Int. Cl.[5] ..... B25B 13/48

[52] U.S. Cl. ..... 81/53.2; 81/445; 81/448

[58] Field of Search ..... 81/53.2, 441, 444–; 279/47

[56] References Cited

U.S. PATENT DOCUMENTS

| | | | |
|---|---|---|---|
| 1,592,987 | 7/1926 | Mayer | 81/445 X |
| 2,721,492 | 10/1955 | Prevost | 81/445 |
| 2,811,067 | 10/1957 | Greer | 81/445 |
| 3,902,384 | 9/1975 | Ehrler | 81/445 |
| 4,513,643 | 4/1985 | McKean | 81/53.2 |
| 4,777,850 | 10/1988 | Polonsky | 81/53.2 |
| 5,031,487 | 7/1991 | Polonsky | 81/53.2 |

*Primary Examiner*—James G. Smith
*Attorney, Agent, or Firm*—Aquilino & Welsh

[57] ABSTRACT

An extractor for removing a broken bolt stud having a pre-drilled bore from a threaded bore including a cylindrical body having a drive head on one end and expander on the opposite end. A collet is movably attached to the cylindrical body by threads permitting lateral movement of the expander against the gripping means causing them to expand and engage the pre-drilled bore. Rotation of the expander permits removal of the broken bolt stud due to the friction between the extractor and the stud.

20 Claims, 3 Drawing Sheets

FIG. 2
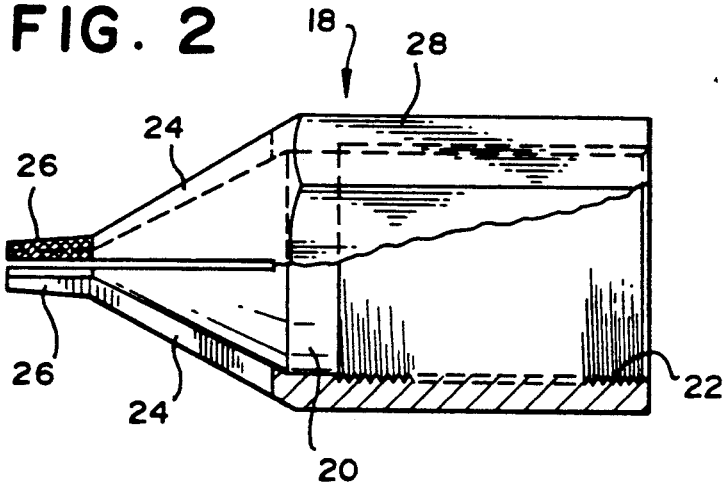
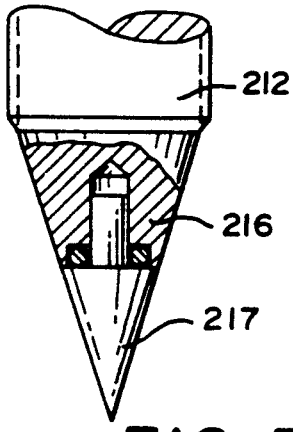
FIG. 5
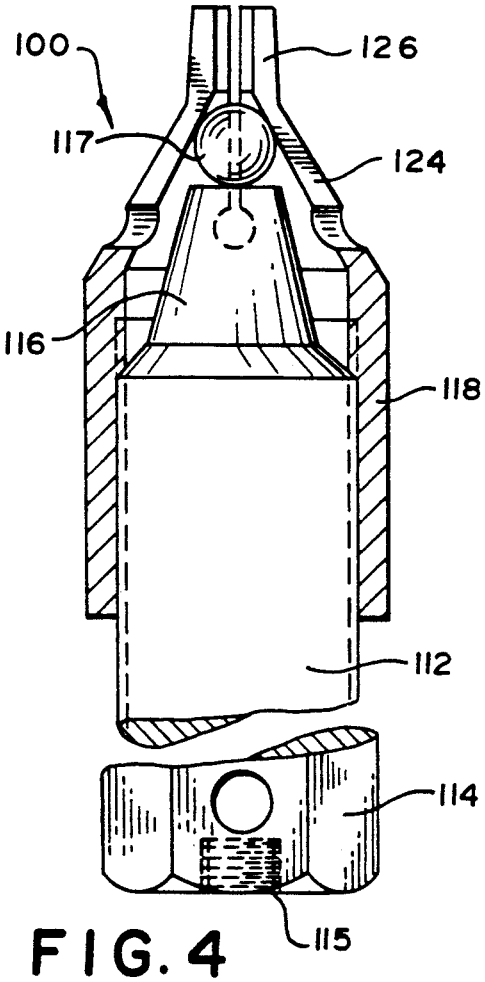
FIG. 4
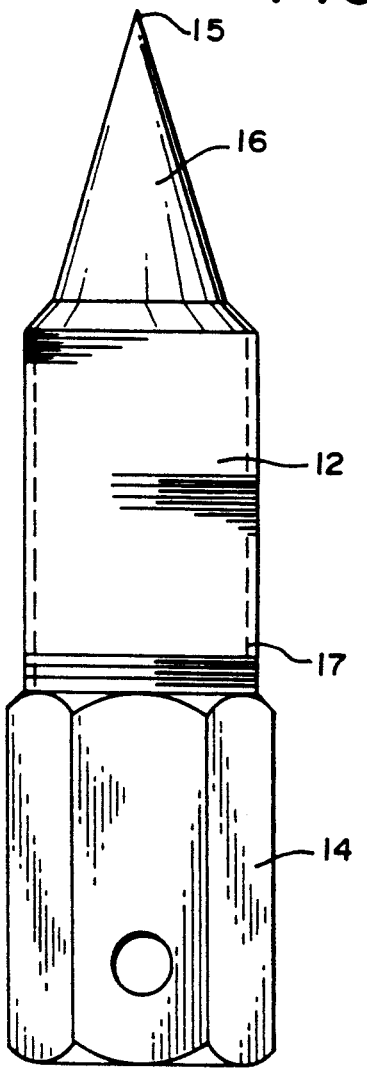
FIG. 3

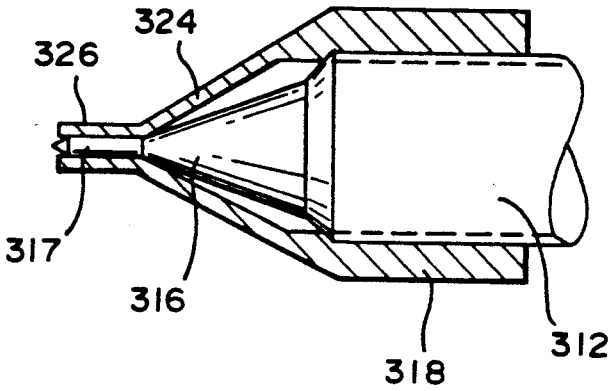
FIG. 6
FIG. 7
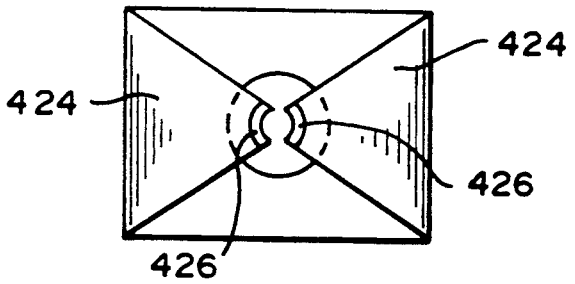
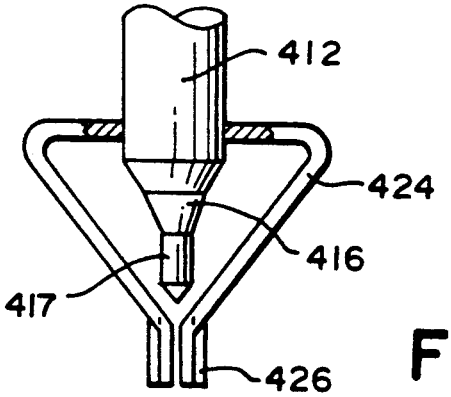
FIG. 8

EXPANDABLE JAW BROKEN BOLT EXTRACTOR

RELATED APPLICATION

The present application is a Continuation-in-Part of Ser. No. 07/705,515, filed May 24, 1991 for EXPANDABLE JAW BROKEN BOLT EXTRACTOR now abandoned.

BACKGROUND OF THE INVENTION

The present invention relates to an expandable jaw broken bolt extractor for removing broken threaded fasteners, such as bolts, and in particular to an extractor designed to remove small diameter broken bolts which are difficult to grasp during the removal process.

Broken bolt extractors, which are commonly available for removing broken bolts from within a threaded bore, are often formed of a pointed tool having gripping teeth or shaped flutes which are structured to engage the sides of a bore drilled through the broken bolt. When the extractor is rotated in the opposite direction to that of the bolt threads, the gripping surfaces grip the internal walls of the bore and remove the broken bolt as the tool is rotated. One of the shortcomings of this type of extractor is for small broken bolt studs it is often difficult to have enough of a gripping surface between the broken stud and the tool to enable the tool to lock onto the stud for removal. This is because the tool frictionally engages only the upper rim surface near the outer edge of the bore and this area is simply not enough to cause the tool to lock on to the broken bolt stud.

With the present invention, an expandable jaw broken bolt extractor extends completely within the bore and during the extraction process resilient jaw members are expanded outwardly against the sides of the bore to provide an increased gripping area between the extractor tool and the broken bolt stud to ensure a solid non-slipping frictional engagement between the parts. Continued rotation of the tool then results in the removal of the broken stud.

The bolt extractor has a cylindrical body. One end serves as a drive means which may be a removable handle or may be an integrally formed hexagonal drive head which cooperates with a suitable hand or power tool, or a threaded hole in which a slide hammer can be installed. The cylindrical body includes threads (in the opposite direction to the threads on the broken stud to be extracted) which receive an expander collet having a plurality of resilient members extending downwardly and inwardly terminating in expansion fingers. The opposite end of the cylindrical body is formed with an expander which extends between the resilient members so that rotation of the cylindrical body in the collet causes the cylindrical body to move longitudinally along the threads. The expander on the cylindrical body moves the fingers of the collet outwardly and as the fingers move apart they engage interior walls of the bore in the broken bolt stud until a firm grip is formed. Continued rotation of the cylindrical body results in a firmer grip between the gripping fingers and the broken bolt stud, permitting removal of the stud.

Among the objects of the present invention is the provision of a broken bolt fastener extractor tool suitable for moving small diameter broken bolts and the provision of a broken bolt extractor tool providing an improved gripping means to engage the broken stud during the removal process.

DESCRIPTION OF THE DRAWINGS

FIG. 2 shows a view of the collet portion of the extractor.

FIG. 3 shows a view of the body portion of the extractor.

FIG. 4 shows a second embodiment of a bolt extractor of the present invention, partially in section.

FIG. 5 shows a detail of a third embodiment of the present invention.

FIG. 6 shows a detail partially in section of a forth embodiment of the present invention.

FIG. 7 shows an end view of a collet member of a fifth embodiment of the present invention.

FIG. 8 shows a side view of the embodiment of FIG. 7.

DESCRIPTION OF THE PREFERRED EMBODIMENTS

Figure 1:
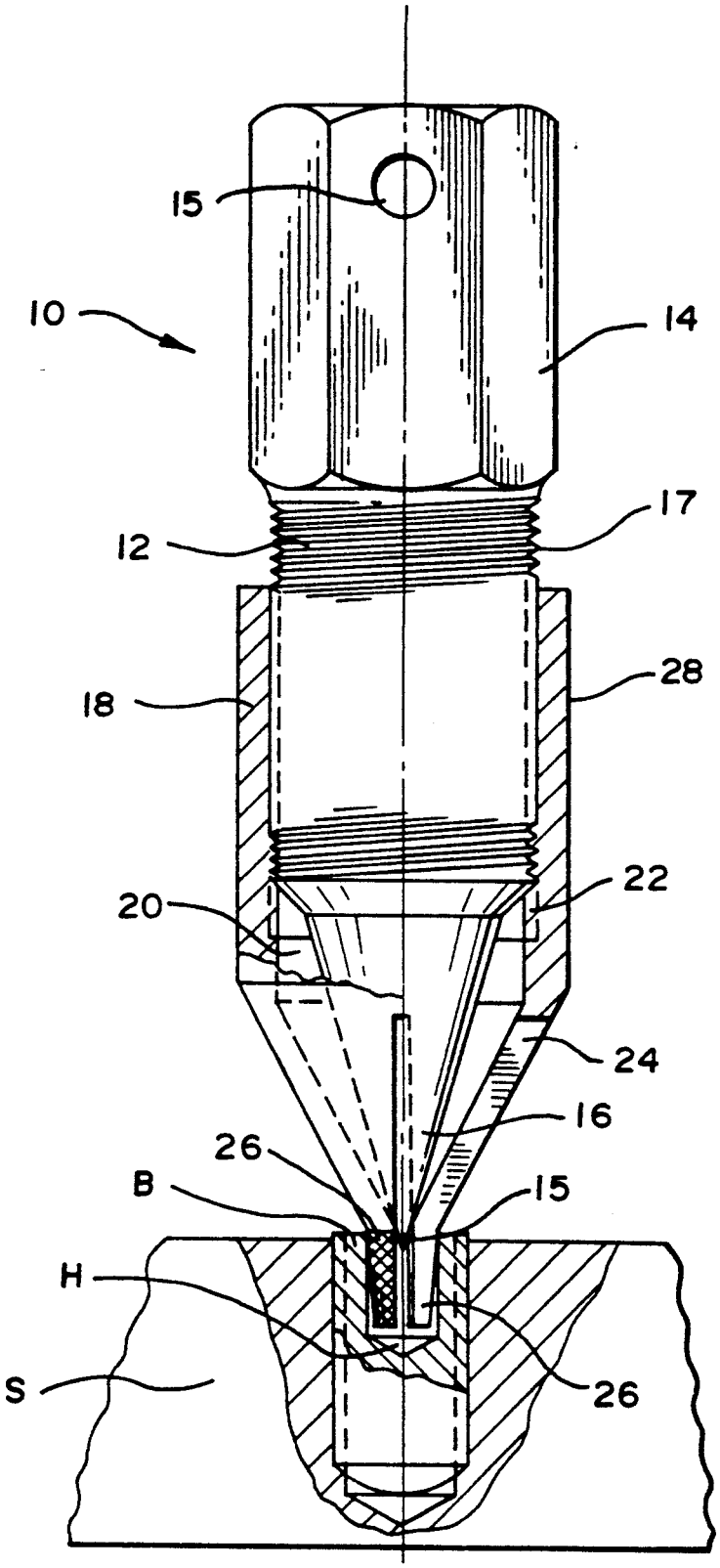
FIG. 1 shows a broken bolt extractor of the present invention partially in section and inserted in a predrilled broken bolt stud.

Referring to the drawings, a broken bolt stud B is trapped within a threaded bore in a support surface S. The stud is threaded in a first direction and has a predrilled hole H, permitting engagement of the extractor of the present invention for conveniently and easily removing the bolt without going through a series of cumbersome and inefficient preparatory steps.

The bolt extractor 10 is formed with a cylindrical body 12 having a drive head 14 integrally formed at one end thereof. The drive head 14 preferably is hexagonal in shape to cooperate with suitable hand wrench or handle suitable for hole 15 or power tool drive means, or a threaded hole 30 into which a slide hammer or similar tool can be installed. The opposite end of the cylindrical body 12 is formed with a conical expander 16 which tapers to a point 19. The exterior of the cylindrical body 12 is provided with threads 17, formed in a second opposite direction to the threads on the stud, to threadedly receive an expander collet 18 as shown. The collet 18 has a series of internal threads 22 which are the same size and direction as the threads 17 on the cylindrical body for cooperation therewith. A plurality of resilient members 24 extend downwardly and inwardly from an annular ring 20 formed on one end of the expander collet 18 terminating in gripping fingers 26 which are resiliently held together due to the spring like action of the resilient members 24. The resilient members 24 are formed with an inner conical surface 23 and an outer conical surface 25, and are separated by a plurality of slots 27. The exterior surfaces of the fingers 26 are roughened with sharp edges or knurls to increase their gripping action. As can be seen, the expansion fingers lie parallel to a longitudinal line through the tapered conical expander 16. The outer surfaces 28 of the collet 18 are preferably formed with a hexagonal shape to permit independent rotation control and gripping by hand or a suitable tool. The outside diameter of the gripping fingers 26 is significantly less than both the cylindrical body 12 and the expander collet 18. This provides an extractor 10 having increased strength and permits the extractor 10 to be used to remove relatively smaller bolt studs while using a large drive tool. It will be appreciated that the only limitation on the force used to operate the tool is the maximum sheer stress that can be tolerated between the fingers 26 and the resilient members 24.

The threaded connection between the collet 18 and the cylindrical body 12 permits rotation therebetween, causing the cylindrical body 12 to move longitudinally relative to the collet 18. When the extractor 10 is used to remove a broken bolt stud B, with a predrilled hole H, drilled in the bolt stud B by a conventional drill or the like. The predrilled hole H is of sufficient diameter t permit insertion of the gripping fingers therein when the fingers are in a non-expanded position. A suitable hand or power drive tool is connected to the drive head 14. Alternately, a slide hammer (not shown) or other similar tool may be connected into the threaded hole 30. This permits gentle hammering of the broken stud in order to break or disconnect any connection between the stud and the support surface, such as might be caused by corrosion, which would prevent rotation of the stud within the threaded hole. The use of a slide hammer will also aid in pulling the stud, should deformation occur in threads between the stud and the support surface. The fingers 26 on the end of the collet 18 are placed within the hole H formed in the bolt stud B. Driving the cylindrical body 12 of the extractor 10 in the stud removal direction, while the collet 18 is held by hand or by interfacial friction, moves the cylindrical body 12 longitudinally along the threads toward the resilient members 24 of the collet 18 causing the expander 16 to engage the interior conical surface 23 of the resilient members 24, causing them to spread apart. The conical surface of the expander 16 tapers at a different angle than the inner conical surface 23 of the resilient members 24. The shape of the conical expander 16 permits it to contact the upper edges of the resilient gripping fingers 26 directly, without having to engage the inner conical surface 23 of the resilient members 24. As the members 24 move apart, the resilient fingers 26 engage the interior of the hole H in the bolt stud B until a firm grip is formed. Continued rotation of the extractor 10 in the same stud removal direction causes a firmer grip by the fingers and all parts move together as a unit because of the frictional force holding them. This results in the unscrewing and removal of the bolt stud B.

FIG. 4 illustrates a second embodiment of an expandable jaw broken bolt extractor 100 of the present invention in this embodiment the extractor includes a cylindrical body 112, a drive head 114, a collet 118, resilient members 124 and expansion fingers 126. This embodiment includes a frustro-conical expander 116 which cooperates with a ball 117 which abuts against the resilient members 124. Rotation of the drive head 114, while the collet is held in a fixed position, and with the fingers are positioned within a hole in a broken stud in the same manner as described with respect to the first embodiment herein above, results in the frustro-conical member 116 forcing the ball 117 against the resilient arms 124 causing them to expand. This, in turn, expands the fingers 126 to grip the broken bolt stud for removal. This embodiment also includes a threaded bore 130 in the drive head 114 which is structured to receive a removable handle or a slide hammer (not shown) so that the extractor 100 may be operated by hand.

FIG. 5 shows a detail of an embodiment of an extractor 200 including a cylindrical body 212 and an expander 216 formed with a point 217 which is rotatable with respect to the base of the expander 216.

FIG. 6 shows still another embodiment of an extractor wherein a cylindrical body 312 includes an expander 316 having a cylindrical point 317 at the end thereof which initially expands the fingers 326 of a collet 318 along there entire length to provide a better grip and to increase stability particularly, when the fingers are very thin and used with small diameter bolts.

Still another embodiment is shown in FIGS. 7 and 8 wherein the collet member 418 is made from a flat piece of stock material appropriately bent to form expansion fingers 426 at the ends thereof.

It will be appreciated that the shape of the conical expander and the cooperating collet need not be limited to the specific shape shown hereinabove, but other modifications may be used in keeping within the scope of the invention as defined in the following claims.

I claim:

1. An extractor for removing a broken bolt stud from a threaded bore, the stud having a predrilled hole therein for engagement by the extractor, comprising:

first and second cooperating and relatively movable parts;

said first part including a drive head on one end thereof, an intermediate cylindrical body and a conical expander on the opposite end thereof; said conical expander defined by an elongated conical surface continuously tapering to a point opposite the drive head;

said second part including a collet having an expandable gripping means formed on one end thereof; and, a pair of co-acting threads formed on said intermediate cylindrical body and on an interior surface of said collet, said threads being in the opposite direction to threads of the broken bolt stud, whereby rotatably moving said cylindrical body in a direction for removing the broken bolt stud causes longitudinal movement of said conical expander to engage and expand said expandable gripping means and whereby continued rotation of the cylindrical body causes rotation of the extractor collet to engage and remove the broken bolt stud.

2. The extractor of claim i wherein said expandable gripping means is formed of at least a pair of resilient gripping members angled downwardly and inwardly from a first end connected to the collet to a second end terminating in gripping fingers having gripping surfaces for gripping the interior of the predrilled hole of the broken bolt stud.

3. The extractor of claim 2 wherein said gripping surfaces on said gripping fingers are characterized by an irregular surface having a plurality of sharp edges to facilitate gripping.

4. The extractor of claim 3 wherein said gripping surfaces are knurled.

5. The extractor of claim 1 wherein said drive head includes means for connection of an auxiliary driving tool to impart a drive force on said drive head.

6. The extractor of claim 5 wherein said means is a threaded opening.

7. An extractor for removing a broken bolt stud from a threaded bore, said broken bolt stud having threads in a first direction and having a predrilled hole therein for engagement by the extractor, comprising:

first and second cooperating and relatively movable parts;

said first part including a drive head on one end thereof, an intermediate cylindrical body and a conical expander on the opposite end thereof; said conical expander defined by an elongated conical surface continuously tapering to a point opposite the drive head;

said second part including a collet having an expandable gripping means formed on one end thereof; and, a pair of co-acting threads, one thread formed on said intermediate cylindrical body and a second thread formed on an interior surface of said collet, said threads being in the opposite direction to threads of the broken bolt stud, said threads permitting longitudinal movement between said body and said collet whereby rotational movement of said cylindrical body causes longitudinal movement of said conical expander to engage and expand said expandable gripping means to engage the predrilled hole in the broken bolt stud and whereby continued rotation of the extractor collet unscrews and removes the broken bolt stud.

8. An extractor for removing a broken bolt stud from a threaded bore, the stud having a pre-drilled hole therein for engagement by the extractor, comprising:

first and second threadedly attached, cooperating and relatively moveable parts;

said first part including a drive head on one end thereof, an intermediate cylindrical body and a conical expander on the opposite end thereof;

said intermediate cylindrical body being formed with threads on the outer surface thereof;

said conical expander defined by an elongated conical surface continuously tapering forming a point opposite the drive head;

said second part including a cylindrical collet with threads on an interior surface thereof; said threads co-acting with the threads on said cylindrical body, such that said collet is threadedly attached on the outer threaded surface of said cylindrical body; said collet including an expandable gripping means integrally formed with one end of said collet;

said first and second threads being in the opposite direction to threads of the broken bolts stud, whereby exerting a force on said drive head and rotatably moving said cylindrical body in a direction for removing the broken bolt stud causes longitudinal movement of said conical expander and said point of said conical expander passes intermediate of said expandable gripping means until continued rotation of said cylindrical body causes said conical expander to expand said expandable gripping means to grip said broken bolt stud whereby continued rotation of the extractor removes the broken bolt stud.

9. The extractor of claim 8 wherein said expandable gripping means is formed by at least a pair of resilient gripping members angled downwardly and inwardly from said collet and terminating in gripping finger, said gripping fingers having gripping surfaces for gripping the interior of the pre-drilled hole of the broken bolt stud.

10. The extractor of claim 9 wherein the resilient gripping fingers have a smaller diameter than said collet.

11. The extractor of claim 9 wherein the resilient gripping fingers have a smaller diameter than said intermediate cylindrical body.

12. The extractor of claim 9 wherein said resilient gripping members each have an inner conical surface angled downwardly and inwardly at a first angle from said collet to said gripping fingers.

13. The extractor of claim 12 wherein said conical expander tapers inwardly to a point at a second angle; said first angle of said inner conical surface of said gripping means being greater than said second angle.

14. The extractor of claim 9 wherein said resilient gripping members and said gripping fingers are separated by slots.

15. The extractor of claim 8 wherein said drive head includes a means,or connection to an auxiliary driving tool to impart a rotational drive force on said extractor.

16. The extractor of claim 8 wherein said drive head includes means for connection to an auxiliary driving tool to impart a hammering drive force on said drive head.

17. The extractor of claim 16 wherein said means for connection is a threaded opening formed in an end of said drive head.

18. The extractor of claim 8 wherein said first and second co-acting threads on said cylindrical body and said collet are in the opposite direction of the threads of said threaded bore.

19. The extractor of claim 9 wherein said fingers being further characterized by a diameter substantially less than the diameter of said collet and the diameter of said intermediate cylindrical body on which said collet is threadedly engaged.

20. An extractor for removing a broken bolt stud from a threaded bore, the stud having a pre-drilled hole therein for engagement by the extractor, comprising:

first and second threadedly attached, cooperating and relatively moveable parts;

said first part including a drive head on one end thereof, an intermediate cylindrical body and a conical expander on the opposite end thereof;

said intermediate cylindrical body being formed with threads on the outer surface thereof;

said conical expander defined by an elongated conical surface continuously tapering forming a point opposite the drive head;

said second part including a cylindrical collet with threads on an interior surface thereof; said threads co-acting with the threads on said cylindrical body, such that said collet is threadedly attached on the outer threaded surface of said cylindrical body; said collet including an expandable gripping means integrally formed with one end of said collet;

said gripping means formed by at least a pair of resilient gripping members angled downwardly and inwardly from said collet and terminating in gripping fingers; gripping fingers being further characterized by a diameter substantially less than the diameter of said collet and the diameter of said intermediate cylindrical body on which said collet is threadedly engaged, said gripping fingers having gripping surfaces for gripping the interior of the predrilled hole of the broken bold stud;

said first and second threads being in the opposite direction to threads of the broken bolt stud, whereby exerting a force on said drive head and rotatably moving said cylindrical body in a direction for removing the broken bolt stud causes longitudinal movement of said conical expander and said point of said conical expander passes intermediate of said expander gripping means until continued rotation of said cylindrical body causes said conical expander to expand said expandable gripping means to grip said broken bolt stud whereby continued rotation of the extractor removes the broken bolt stud.

* * * * *